US006547103B1

(12) United States Patent
Elliott

(10) Patent No.: US 6,547,103 B1
(45) **Date of Patent: *Apr. 15, 2003**

(54) METHOD AND APPARATUS FOR SERVING MULLED WINE

(76) Inventor: Ian Richard Elliott, Little Netherwood, Stoke Bliss, Tenbury Wells, Worchestershire, WR15 8TR (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/242,188

(22) PCT Filed: May 19, 1997

(86) PCT No.: PCT/GB97/01375

§ 371 (c)(1),
(2), (4) Date: Feb. 9, 1999

(87) PCT Pub. No.: WO97/44273

PCT Pub. Date: Nov. 27, 1997

(30) Foreign Application Priority Data

May 17, 1996 (GB) ..... 9610413

(51) Int. Cl.[7] ..... B67D 5/62

(52) U.S. Cl. ..... 222/146.5; 222/453; 141/351; 141/362; 99/288; 99/301

(58) Field of Search ..... 222/146.5, 453, 222/54, 23, 219, 1, 476; 99/288, 301; 219/628; 141/351, 360, 362, 82, 251, 255, 258

(56) References Cited

U.S. PATENT DOCUMENTS

| | | | | | |
|---|---|---|---|---|---|
| 1,260,334 | A | * | 3/1918 | Cordley | 222/453 |
| 1,538,483 | A | * | 5/1925 | Grantham | 141/352 |
| 2,054,881 | A | * | 9/1936 | Saunders | 221/114 |
| 2,519,115 | A | * | 8/1950 | Costakos | 222/128 |
| 3,046,869 | A | * | 7/1962 | Reynolds | 99/289 |
| 3,711,681 | A | * | 1/1973 | Leuschner et al. | 99/288 |
| 3,835,295 | A | | 9/1974 | Ronchese | |
| 4,494,600 | A | | 1/1985 | DeLau | |
| 4,582,230 | A | * | 4/1986 | Vierkotter | 222/442 |
| 5,067,395 | A | | 11/1991 | Timm | |
| 5,097,991 | A | * | 3/1992 | Lance | 222/453 |
| 5,186,367 | A | * | 2/1993 | Hickerson | 222/453 |
| 5,210,386 | A | * | 5/1993 | Sprunger | 99/288 |
| 5,397,031 | A | | 3/1995 | Jensen | |

FOREIGN PATENT DOCUMENTS

| | | |
|---|---|---|
| AT | 550594 | 12/1984 |
| DE | 1917713 | 10/1970 |
| DE | 3606032 A1 | 8/1987 |
| EP | 0-581-491 A1 | 2/1994 |
| FR | 2579090 | 3/1985 |
| GB | 1057957 | 2/1967 |
| GB | 2151210 A | 7/1985 |

* cited by examiner

*Primary Examiner*—Gene Mancene
*Assistant Examiner*—Frederick Nicolas
(74) *Attorney, Agent, or Firm*—Wallenstein & Wagner, Ltd.

(57) ABSTRACT

A method and apparatus for serving a heated alcoholic beverage is disclosed. The method and apparatus includes supplying an alcoholic beverage mix, such as a mulled wine mix, which is connected to a serving tap. The mulled wine is heated between leaving the source and being serviced from the tap.

4 Claims, 5 Drawing Sheets

METHOD AND APPARATUS FOR SERVING MULLED WINE

BACKGROUND OF THE INVENTION

This invention relates to serving mulled wine.

Mulled wine is wine optionally containing sugar, herbs, spices and perhaps egg-yolk and other additives, which is heated. Indeed, the invention is concerned with serving any heated beverage that can be supplied in pre-mix form, and in particular, aside from mulled wine, is also concerned with toddies, which usually involve spirits, water and sugar, heated. Thus, for example, sake and fruit cups are also within the scope of the invention.

Customarily, a mulled wine is prepared as a mix and heated in a pan from which it is served by a ladle or by dipping cups, rather as a fruit cup. A toddy is normally prepared as a mix of the various ingredients in a glass to which is added hot water from a kettle.

Neither of these preparation methods is satisfactory from the point of view of dispensing hot beverages in a bar.

The present invention provides a method and apparatus for serving mulled wine (which, as mentioned, includes toddy) which avoids the disadvantage of the conventional preparation methods.

BRIEF SUMMARY OF THE INVENTION

The invention comprises a method for serving mulled wine in which a mulled wine mix is supplied from a source connected to a serving tap and heated between leaving the source and being served from the tap.

The mix may be delivered from the source into a standard serving measuring vessel and then heated. By "standard serving" is meant any vessel capacity that may be regarded as a local or statutory standard—a serving of 125 ml is often regarded as a standard wine serving. Servings for hot toddy, of course, could be different.

The vessel may be of the kind known as an "optic" in which the contents are delivered through the tap while the vessel is closed to the source, and once the contents have been delivered, the tap is closed and a fresh charge admitted from the source. Th e term "optic" usually implies a glass vessel the action of which can be visually checked and which, in normal use, is subject to inspection by weights and measures inspectors.

The mix may be heated to a predetermined temperature (say 50° C.) and may be served from the tap automatically on reaching the predetermined temperature.

The method may use microwave or electric resistance heating. In the latter case, the mulled wine mix may be passed through a heated tube, in which the heating is effected on the flowing mix, or the heating may be effected on the mix while held in a holding vessel. The mix may be delivered into an optic, then discharged therefrom and thence passed through the tube.

The invention also comprises apparatus for serving mulled wine, comprising a heating vessel having a connection to a supply of mulled wine mix and a serving tap, the apparatus being comprised in a bar-top serving format and being adapted to receive a charge of mulled wine mix from the supply thereof into the vessel, there to heat up said charge, thence to deliver the heated charge through the tap.

The connection to the supply of mulled wine mix may comprise a seating for an upturned bottle of mix.

The heating vessel may comprise an "optic" type vessel.

Thermostatic means may limit the temperature to which the mix is heated.

The apparatus may comprise means to automatically deliver the mix through the tap once heated—actuated, for example, by the thermostat. A thermostat may, of course, simply give an indication as to when the serving temperature is attained, so that a glass may be presented to the optic for filling in the usual way.

The heating vessel may comprise a flow-through vessel in which the mix is heated as it flows towards the tap. The mix may flow past the inner and outer surfaces of the flow-through vessel. The apparatus may further comprise an optic into which the mix is delivered, the flow-through vessel being adapted to receive the mix when said optic is discharged.

Alternatively, the heating vessel may comprise a holding vessel in which the mix is held whilst being heated.

BRIEF DESCRIPTION OF THE DRAWINGS

Embodiments of mulled wine serving apparatus and methods according to the invention will now be described with reference to the accompanying drawings, in which.

The drawings illustrate methods of and apparatus for serving mulled wine from a bottle 11 of mulled wine mix, i.e. wine, sugar, spices, lemon and so on according to the recipe. The essence of the method is concerned with the delivery of a heated drink, the ingredients are, of course, optional, so by mulled wine is to be understood essentially any heated alcoholic or non-alcoholic beverage including gl ühwine, punches, toddies and so forth.

The usual manner of preparation of such drinks is sufficiently troublesome as to preclude them from the regular offering of bars except—in the case of glühwine, for example—where a substantial batch may be prepared and kept heated in anticipation of ready sale to skiers. By and large, it is not considered desirable to keep the beverage hot for any length of time.

A recipe for Old Castle Punch is "The Art of Mixing Drinks", based on Esquire Drink Book, Bantam Books, New York, 1956 requires the melting of two cups of loaf sugar in one quart of water in a granite saucepan, letting the mixture come to the boil. Two bottles of Rhine wine are added reducing the heat under the saucepan. A lump of sugar is soaked in a silver spoon, and a pint of good rum poured gradually over. The punch is served very hot as it comes off the fire. Not the sort of thing that can be handled by a barman in a theatre interval for the occasional client not wanting the standard gin and tonic.

In the present proposal it is envisaged that the mulled wine mix will be supplied as a branded item in bottles—though this does not, of course, preclude a barman making up his own recipe which will keep, bottled, in such quantities as may be appropriate to the type of bar, the season of the year and so forth. Such a bottle is what is referred to hereinafter as "the source" though it must be remembered that other kinds of source are not excluded from consideration, nor need the mix be prepared ahead of serving—the source may be two or more sources of components, say a syrup laced with spices and a separate bottle of wine which are mixed at point of sale. Other sources might comprise, for example, a winebox or even a vat which might be stored on a shelf or in a cellar. In the latter instance, a suitable pumping arrangement would be required in order to transport mix from the cellar to the point of use.

In any event, the mulled wine mix, in the present examples, is supplied from the source—bottle 11—connected to a serving tap 12 and heated between leaving the source 11 and being served from the tap 12.

The mix, in the embodiments described herein, is delivered from the source 11 into a standard serving measuring vessel 13. As mentioned above a standard serving may merely mean a standard serving for a particular bar or for a particular drink, and does not necessarily imply conformation to any weights and measures regulations—but usually will, of course.

Figure 1:
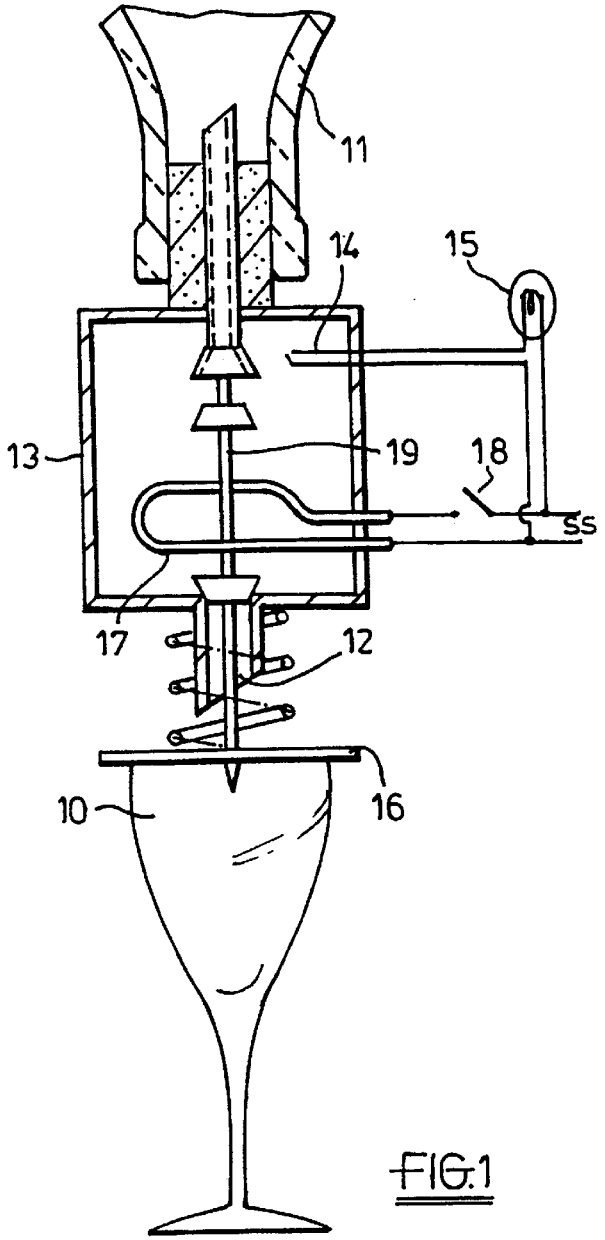
FIG. 1 is a diagrammatic sectional elevation of a first embodiment.
Figure 2:
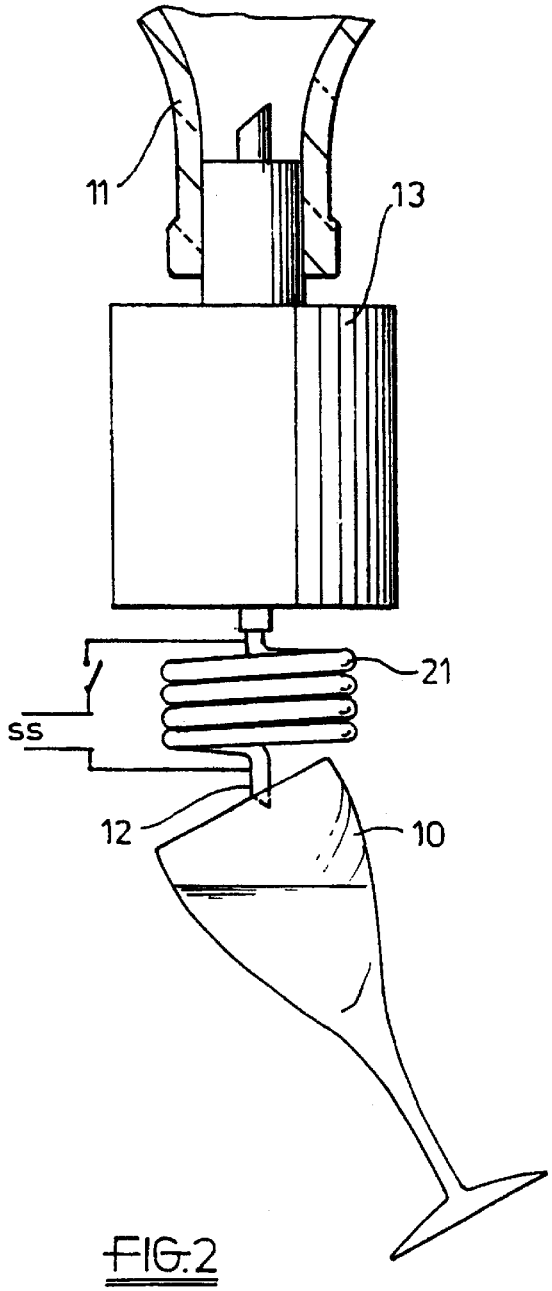
FIG. 2 is a diagrammatic elevation of a second embodiment.

In FIGS. 1 and 2, the vessel 13 is of the kind known as an "optic" (though neither is a standard kind of optic) in which the contents are delivered through the tap 12 while the vessel 13 is closed to the source 11 and, once the contents have been delivered, the tap 12 is closed and a fresh charge admitted from the source.

In all embodiments described herein, the mix is heated to a predetermined temperature.

In the embodiment of FIG. 1, the mix is served from the tap 12 on reaching the predetermined temperature. A thermostat device 14 measures the temperature of the mix in the vessel 13 and lights an indicator lamp 15 at the predetermined temperature. The glass 10 to be filled can then be pushed up on to the contact bar 16 of the optic vessel 13 to release the heated mix through the tap 12 into the glass 10.

A microwave heating jacket could surround the vessel 13 but, as illustrated, the vessel 13 contains an electric resistance heating element 17—like, perhaps, a kettle element—connected to the main supply by an on/off switch 18.

This simple and inexpensive arrangement could, of course, be made automatic by arranging that pushing the glass 10 up against the bar 16 switches on the heater 17 and, when the thermostat 14 senses the predetermined temperature, the heater 17 is switched off and the optic valves operated to discharge the optic while sealing off the source 11—the valves not, of course, being connected directly to the stem 19, but being actuated electrically.

A slightly different arrangement might have the valves connected to the stem 19 but the bar 16 having some initial lost motion that on initial upward pressure from the glass 10 turns on the heater 17 but keeps the stem 19 locked in position, to be released, with simultaneous heater switch-off, on the correct temperature being reached. It would be desirable to have the vessel contents heated within the compass of a few seconds only, with such an arrangement.

FIG. 2 depicts a "flow through" embodiment in which the heater 21 is external to the vessel 13, being in the form of a metal tube of helical form through which a heating current flows when the vessel 13 releases its charge. The current and its duration are arranged to be such that the mix reaches the desired temperature by the time it leaves the end of the tube. Such an arrangement may avoid the build up of deposits inside the vessel that may be experienced when the mix is heated in the vessel.

In any event, it may be arranged that vapours arising during the course of heating the mix, possibly as a result of any remanent heat vapourising any droplets remaining in the apparatus after the bulk of the charge has been delivered, can be released to atmosphere as a attractant to encourage further sales.

It may also be arranged that a droplet or two is "leaked" to the heater during quiet business times to advertise the product.

Figure 3:
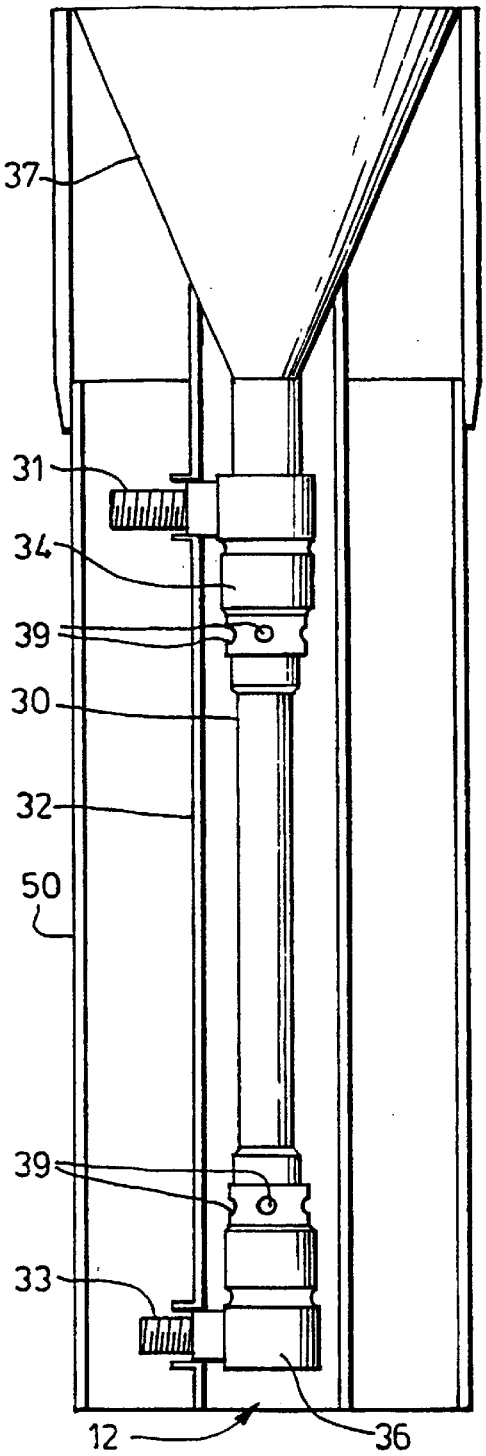
FIG. 3 is a diagrammatic sectional elevation of a third embodiment.

FIG. 3 depicts another "flow through" embodiment which comprises two tubular members 30, 32 and two heating connectors 34, 36. The first tubular member 30 is formed in a conductive material, preferably a metal such as stainless steel. The first tubular member 30 is resistively heated via the two heating connectors 34, 36. Electrical connection to a power supply (not shown) is made via bolts 31, 33 (partially shown in FIG. 3) each of which locates in a grooved aperture circumferentially located on the heating connectors 34, 36. The heating connectors 34, 36 have a longitudinal channel into which the first tubular member 30 is located, via a friction fit. The spout of a funnel 37 also locates in the longitudinal channel of the upper heating connector 34. The heating connectors 34, 36 further comprise a plurality of circumferentially spaced apertures 39. The second tubular member 32 is formed in a non-conductive material, preferably a plastic, and surrounds the first tubular member 30 and the heating connectors 34, 36.

In use, the mix flows from a source into the funnel 37 and thence into the upper heating connector 34. A portion of the mix flows through the first tubular member 30 and is heated by the inner surface thereof. The remainder of the mix flows out of the circumferentially spaced apertures 39. This latter portion of the mix then flows past the outer surface of the first tubular member 30 and is heated thereby. The heated mix exits from the lower aperture of the second tubular member 32, said lower aperture thereby comprising the tap 12. A portion of this heated mix exits via the longitudinal channel of the lower heating connector 36, whilst a further portion exits from around the periphery of the lower heating connector 36. Careful adjustment of the number and size of the circumferentially spaced apertures 39 results in a substantially 50-50 division between the portions of mix being heated by the inner and outer surfaces of the first tubular member 30. It is an advantage that both surfaces of the first tubular member 30 are used in the heating process, since efficiency is increased.

A third tubular member 50 provides protection for the arrangement (another consequence of such shielding being that the arrangement has a more aesthetically pleasing appearance).

Figure 4:
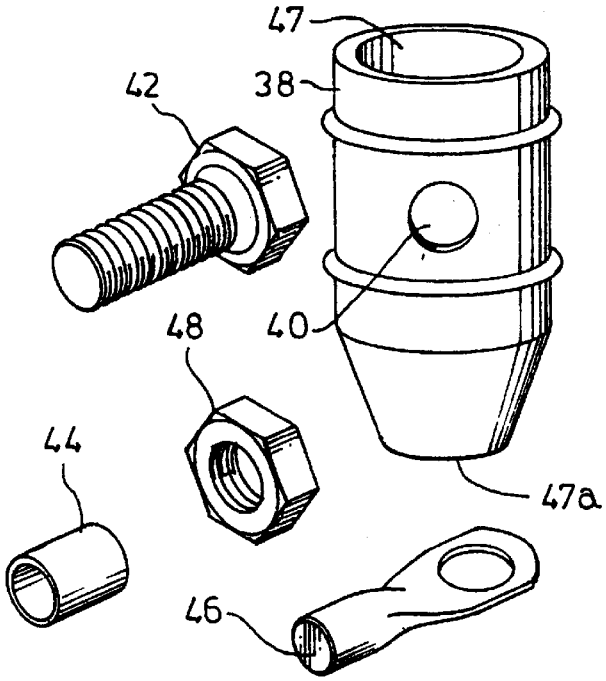
FIG. 4 shows components of a heating connector.
Figure 5:
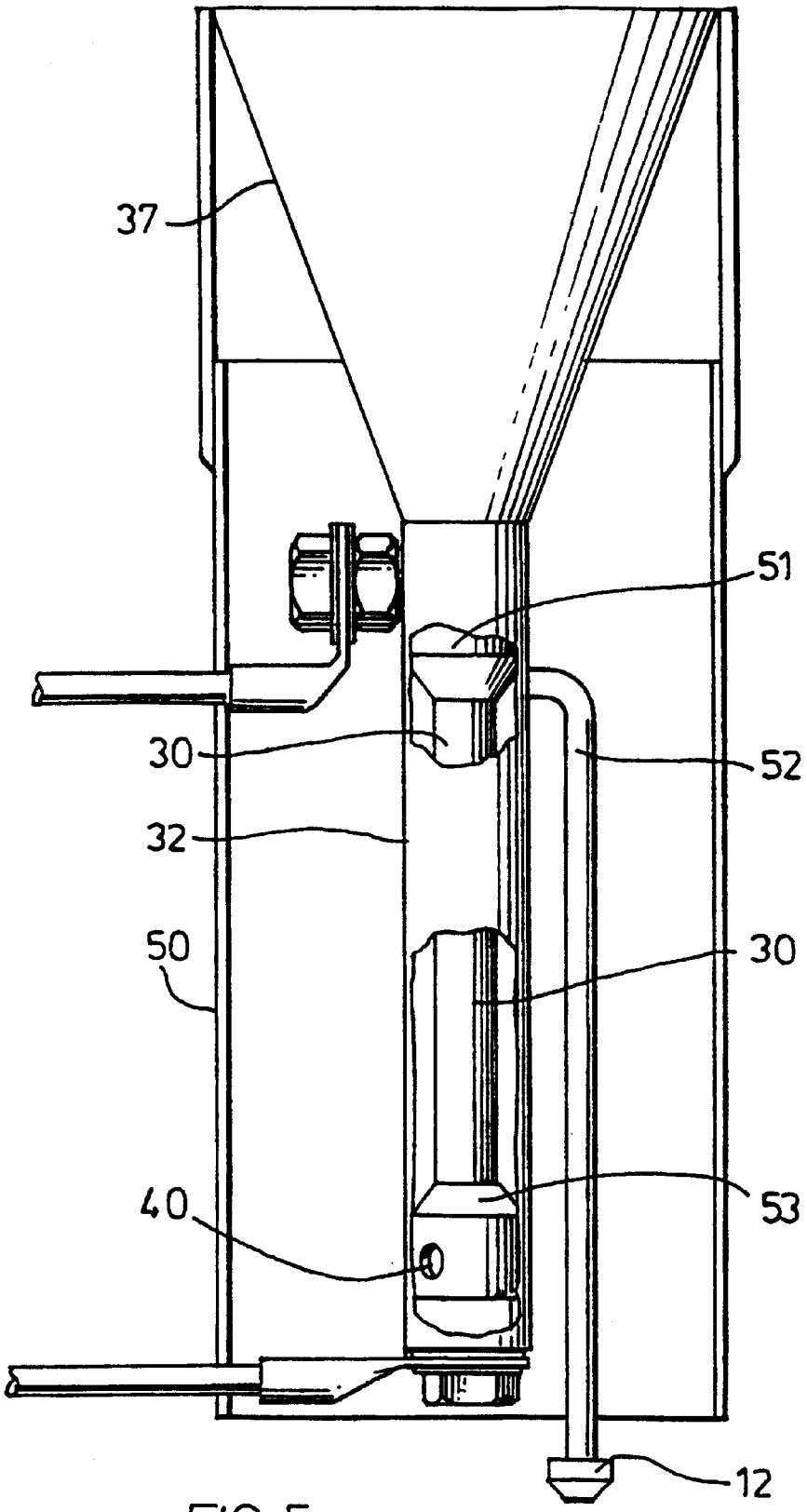
FIG. 5 is a diagrammatic, cut away elevation of a fourth embodiment.

FIG. 5 depicts a further "flow through" embodiment. In common with FIG. 3, this latter embodiment comprises three tubular members 30, 32, 50, two heating connectors 51, 53 and a funnel 37. FIG. 4 shows the components of the upper heating connector 51, which comprises a tubular body 38 having a grooved circumferentially located aperture 40 into which a bolt 42 may be positioned. Electrical connection to a power supply (not shown) is made with a lead 44 which is attached to a connecting piece 46 which in turn is coupled to the bolt 42 with one or more nuts 48. The tubular body 38 has a longitudinal channel 47 into which the first tubular member 30 is located (at 47*a*) by a friction fit.

A slightly different configuration is adopted with the lower heating connector 53, the bolt 42 now being located in the longitudinal channel 47, which is grooved. A single circumferentially located aperture 40 or a plurality thereof may be provided—the function of the aperture or apertures 40 is now to permit mix to flow therethrough.

In use, the contents of the source flow down the funnel 37 into the upper heating connector 52 and thence into the first tubular member 30. The mix then flows from the circumferentially located aperture 40 (the first tubular member 30 terminating above the aperture 40), eventually exiting the system and entering a recipient glass via the tap 12 which comprises one end of the side arm 52. By employing this "dual pass" approach, all of the contents of the source are heated by both the inner and outer surfaces of the first tubular member 30, resulting in i) more efficient heating, ii) a reduction in the length of the first tubular member 30 which permits the use of a physically smaller arrangement and iii) a reduction in the required heating time. A small residue will remain in the second tubular member 32 after a sample of mulled wine has been discharged, and it is desirable that the system is able to remove this residue. The residue might be removed by a syphon, or discharged via a suitable mechanically or electronically actuated valve, such as a solenoid.

Figure 6:
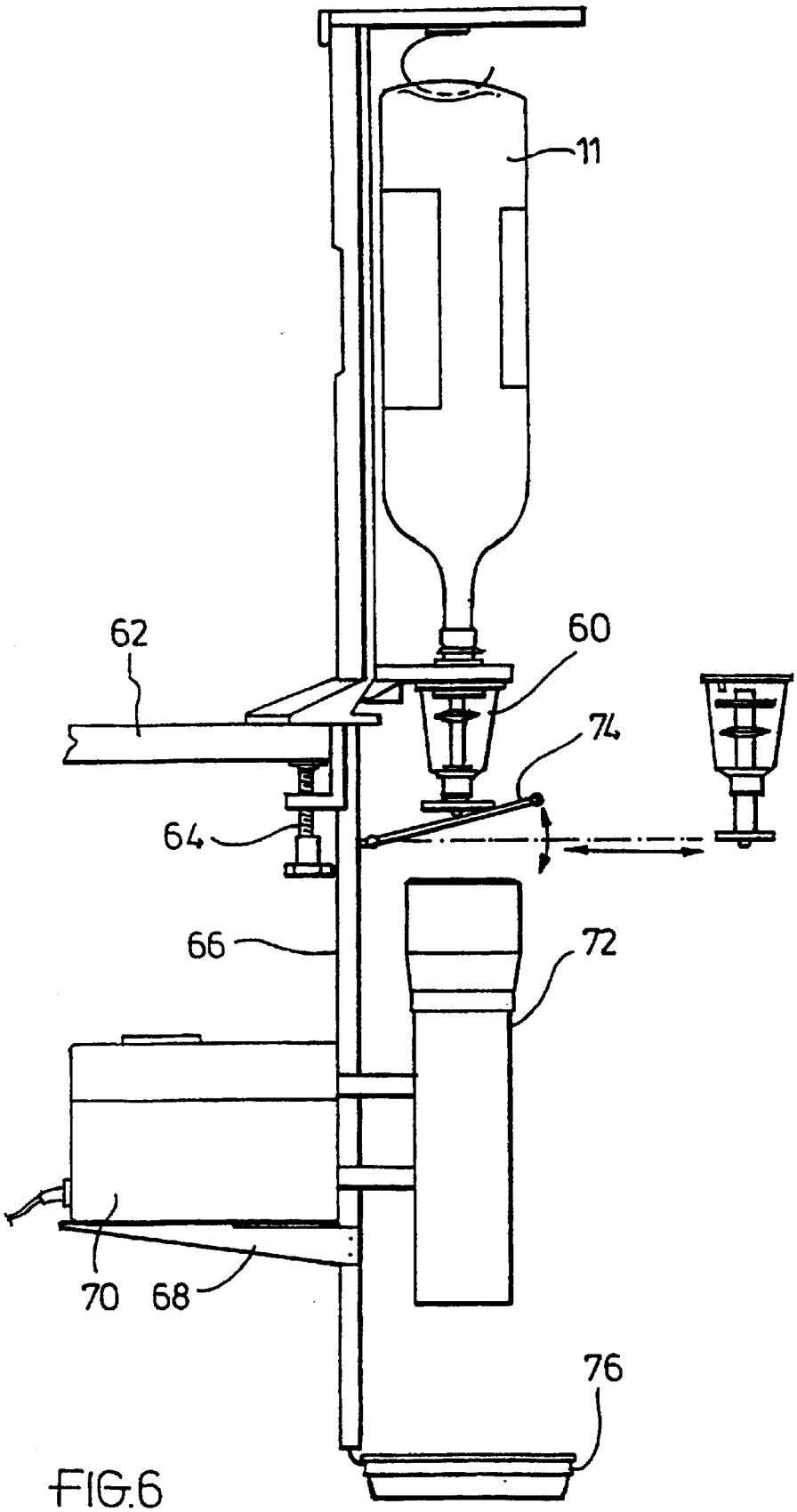
FIG. 6 is a side elevation of a bar top arrangement.
Figure 7:
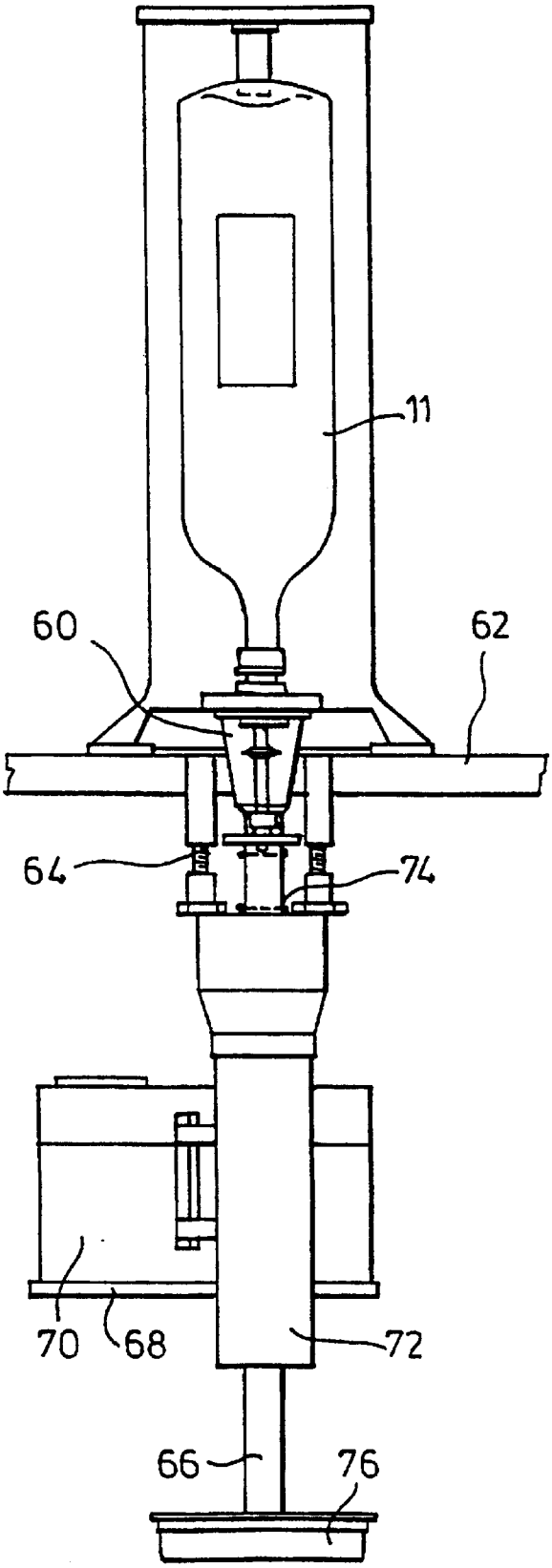
FIG. 7 is a front elevation of a bar top arrangement.

The "flow through" embodiments of FIGS. 3 and 4 require some form of metering which permits the correct quantity of mix to be extracted from the source and flowed through the heating stage. FIGS. 6 and 7 depict a preferred embodiment which is adapted for convenient coupling with.a traditional bar optic arrangement. FIGS. 6 and 7 show a source (or bottle) 11 in connection with a standard optic 60. The source/optic arrangement is positioned on a shelf 62 with a clamp 64. A column 66 extends downwardly from the clamp 64 towards the bar top or working surface. The column 66 supports a platform 68 upon which a heater power supply 70 is positioned, and also provides support for the heating arrangement 72. The heating arrangement 72 employed might be, for example, the embodiments depicted in either FIG. 3 or 5.

The arrangement of FIGS. 6 and 7 also comprises a lever 74, pivotably mounted on the column 66, which can be pivoted thereabout in order to dispense mix from the optic 60. Any residue is collected in a tray 76.

The arrangements described are exemplary only; other variants will suggest themselves to the reader on the basis of the disclosure herein.

What is claimed is:

1. A method for serving a heated alcoholic beverage comprising the steps of:

providing a vessel connected to a serving tap, the vessel comprising:

a top opening and a bottom opening, the vessel having disposed within a first stopper attached to the top opening and a second stopper attached to the bottom opening;

a source of an alcoholic beverage mix positioned at the top opening of the vessel;

a heater for heating the alcoholic beverage to a predetermined temperature, the heater being disposed within the vessel;

a sensor for actuating the second stopper when the alcoholic beverage reaches the predetermined temperature and, a tap connected to the bottom opening of the vessel, wherein when the sensor is activated, the second stopper moves away from the bottom opening and the first stopper engages and closes the top opening of the vessel thereby closing the top opening from the source;

supplying an alcoholic beverage mix from a source into the vessel;

heating the alcoholic beverage mix between leaving the source and before serving the alcoholic beverage mix from the tap;

dispensing the heated alcoholic beverage mix through the tap for immediate serving; and, refreshing the vessel with a fresh charge from the source after serving the heated alcoholic beverage mix through the tap.

2. The method according to claim 1 wherein the alcoholic beverage mix is a mulled wine mix.

3. The method according to claim 1 wherein the heater includes a microwave heater.

4. The method according to claim 1 wherein the heater includes an electric resistance heater.

* * * * *